US007363870B2

(12) United States Patent
Lothe

(10) Patent No.: US 7,363,870 B2
(45) Date of Patent: Apr. 29, 2008

(54) METHOD AND DEVICE FOR PROTECTING A VESSEL'S LOADING SPACE FROM EXCESS PRESSURE

(75) Inventor: Per Lothe, Førresfjorden (NO)

(73) Assignee: Knutsen OAS Shipping AS (NO)

( * ) Notice: Subject to any disclaimer, the term of this patent is extended or adjusted under 35 U.S.C. 154(b) by 0 days.

(21) Appl. No.: 10/565,228

(22) PCT Filed: Jul. 21, 2004

(86) PCT No.: PCT/NO2004/000225

§ 371 (c)(1),
(2), (4) Date: Jun. 9, 2006

(87) PCT Pub. No.: WO2005/007505

PCT Pub. Date: Jan. 27, 2005

(65) Prior Publication Data

US 2007/0125286 A1 Jun. 7, 2007

(30) Foreign Application Priority Data

Jul. 22, 2003 (NO) ..... 20033298

(51) Int. Cl.
*B63B 25/12* (2006.01)

(52) U.S. Cl. ..... 114/74 R

(58) Field of Classification Search ..... 114/74 R, 114/74 A

See application file for complete search history.

(56) References Cited

U.S. PATENT DOCUMENTS

| | | | | |
|---|---|---|---|---|
| 3,031,856 | A * | 5/1962 | Wiedemann et al. | 62/48.2 |
| 3,113,544 | A * | 12/1963 | Malcolmson et al. | 114/74 R |
| 3,319,433 | A | 5/1967 | Pauliukonis et al. | |
| 3,537,416 | A | 11/1970 | Cowles | |
| 3,863,460 | A | 2/1975 | Straile et al. | |
| 3,886,885 | A * | 6/1975 | Becker et al. | 114/74 A |
| 5,803,005 | A | 9/1998 | Stenning et al. | |

FOREIGN PATENT DOCUMENTS

| | | |
|---|---|---|
| NO | 133461 | 5/1976 |
| WO | WO 97/16678 | 5/1997 |

OTHER PUBLICATIONS

International Search Report having a mailing date of Nov. 30, 2004, for PCT/NO2004/000225.

* cited by examiner

*Primary Examiner*—Sherman Basinger
(74) *Attorney, Agent, or Firm*—Andrus, Sceales, Starke & Sawall, LLP

(57) ABSTRACT

A method and a device for protecting a vessel's loading space, the hold (1) of the vessel being provided with cargo pressure tanks (12), from excess pressure if a gas leakage should occur in the hold (1), the vessel being provided with a ventilating duct (8) which is separated in a gastight manner from the remaining rooms of the vessel and extends along the hold (1) of the vessel.

6 Claims, 3 Drawing Sheets

II-II

I–I

METHOD AND DEVICE FOR PROTECTING A VESSEL'S LOADING SPACE FROM EXCESS PRESSURE

CROSS REFERENCE TO RELATED APPLICATION

The present application is the U.S. national stage application of International Application PCT/NO2004/000225, filed Jul. 21, 2004, which international application was published on Jan. 27, 2005 as International Publication WO 2005/007505. The International Application claims priority of Norwegian Patent Application 20033298, filed Jul. 22, 2003.

BACKGROUND OF THE INVENTION

This invention relates to a method for protecting a vessel's loading space from excess pressure. More particularly it concerns a method for protecting a loading space provided with cargo pressure tanks from excess pressure if a leak should occur in a cargo pressure tank or piping belonging thereto. The invention also includes a device for practicing the method. By loading space is meant in this context the ship's hold and adjacent rooms, for example a valve compartment and a piping room.

The shipping of gaseous petroleum products has essentially been carried out by means of the so-called "Liquified Natural Gas Method" (Liquified Natural Gas—LNG). The method comprises the cooling of gas to a liquid form, after which the gas can be transported in ship tanks at atmospheric pressure. Expensive equipment is required at both the point of shipment and the terminal for the treatment of the gas. Since the gas has to be cooled to a relatively low temperature, up to one fifth of the gas is spent on running the cooling and heating processes. Energy consumption like that just for the transport-related processes is expensive and moreover environmentally alarming.

Several other ship-based solutions have been proposed, wherein the gas is pressurized and/or cooled in order to achieve a gas density practical for the purpose. Such solutions have not become widely used in practice, but a solution in which a large number of vertical, tubular pressure tanks are placed in a ship's hold, has drawn considerable attention. The method is referred to as "Pressurised Natural Gas" (PNG). In accordance with such a method the gas is compressed at the point of shipment to an overpressure of a few hundred bars, and the gas is then filled into the cargo pressure tanks located on the ship. The cooling is limited to a simple and cheap removal of the compression heat from the gas, so that the transport temperature will be close to the ambient temperature.

By the use of cargo pressure tanks and associated piping, which are subjected to a relatively high pressure during the transport, it is of great importance in terms of safety that gas that might flow out of the cargo pressure tank or the piping by a possible leak, can be dealt with safely, without this involving the risk of damage to the rest of the cargo pressure tanks or the ship.

In the planning of a ship's configuration, possible unintended events that might occur must be analysed, after which the ship is designed with technical solutions arranged to relieve such events.

SUMMARY OF THE INVENTION

The invention has as its object to indicate a method and a device, which protect, on several levels, the ship's loading space from undesired excess pressure, while at the same time a possible excess pressure is relieved in a controlled and to the ship safe manner.

The object is realized in accordance with the invention through the features defined in the description below and in the following Claims.

The ship includes four kinds of rooms: hold, valve compartment, pipe corridor and ventilating duct. In principle, these rooms are separated in a gastight manner from each other and from the rest of the ship's rooms. The hold is most preferably divided into a number of hold sections. Each hold section comprises a number of cargo pressure tanks and is provided with an adjacent valve compartment. The hold volume enclosing the cargo pressure tanks is normally filled with a non-flammable gas.

One or more pipe corridors and ventilating ducts extend preferably longitudinally of the ship.

The ship's loading and unloading pipe is placed in the pipe corridor and is connected to the cargo pressure tanks of each hold section by means of a distribution pipe and a necessary number of shut-off valves and connecting pipes.

All valves belonging to the piping for connecting the cargo pressure tanks to the loading and unloading pipe are placed in the valve compartment. Preferably, there are no valves of any kinds placed in the hold.

The ventilating duct discharges into a discharge duct whose discharge to the atmosphere is placed at a safe distance from possible ignition sources and personnel.

The hold sections, valve compartments and pipe corridors are connected through at least one pressure relief check valve to the ventilating duct. A possible leakage leading to a pressure build-up in the hold, valve compartment or pipe corridor will thereby be ventilated through the ventilating duct.

By supplying fresh air to the pipe corridor and/or the valve compartment it is possible to carry out repair work and shut-off work in the pipe corridor, or the valve compartment itself, if a leakage is being ventilated through the ventilating duct.

BRIEF DESCRIPTION OF THE DRAWINGS

In what follows there will be described a non-limiting example of a preferred embodiment and method visualized in the accompanying drawings, in which.

DETAILED DESCRIPTION OF THE INVENTION

Figure 1:
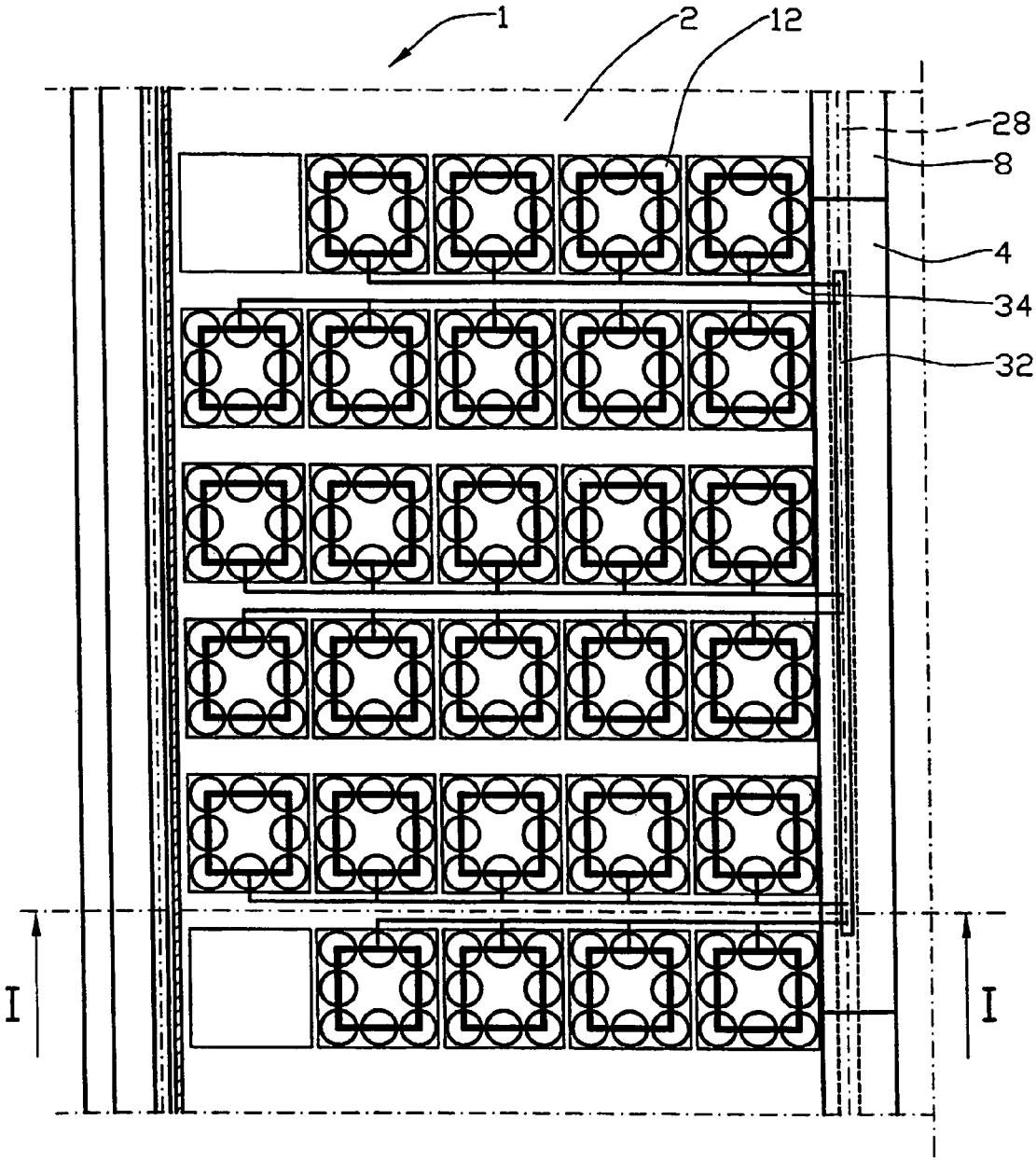
FIG. 1 shows schematically in a section a greater number of cargo pressure tanks installed in the hold section of a ship.
Figure 2:
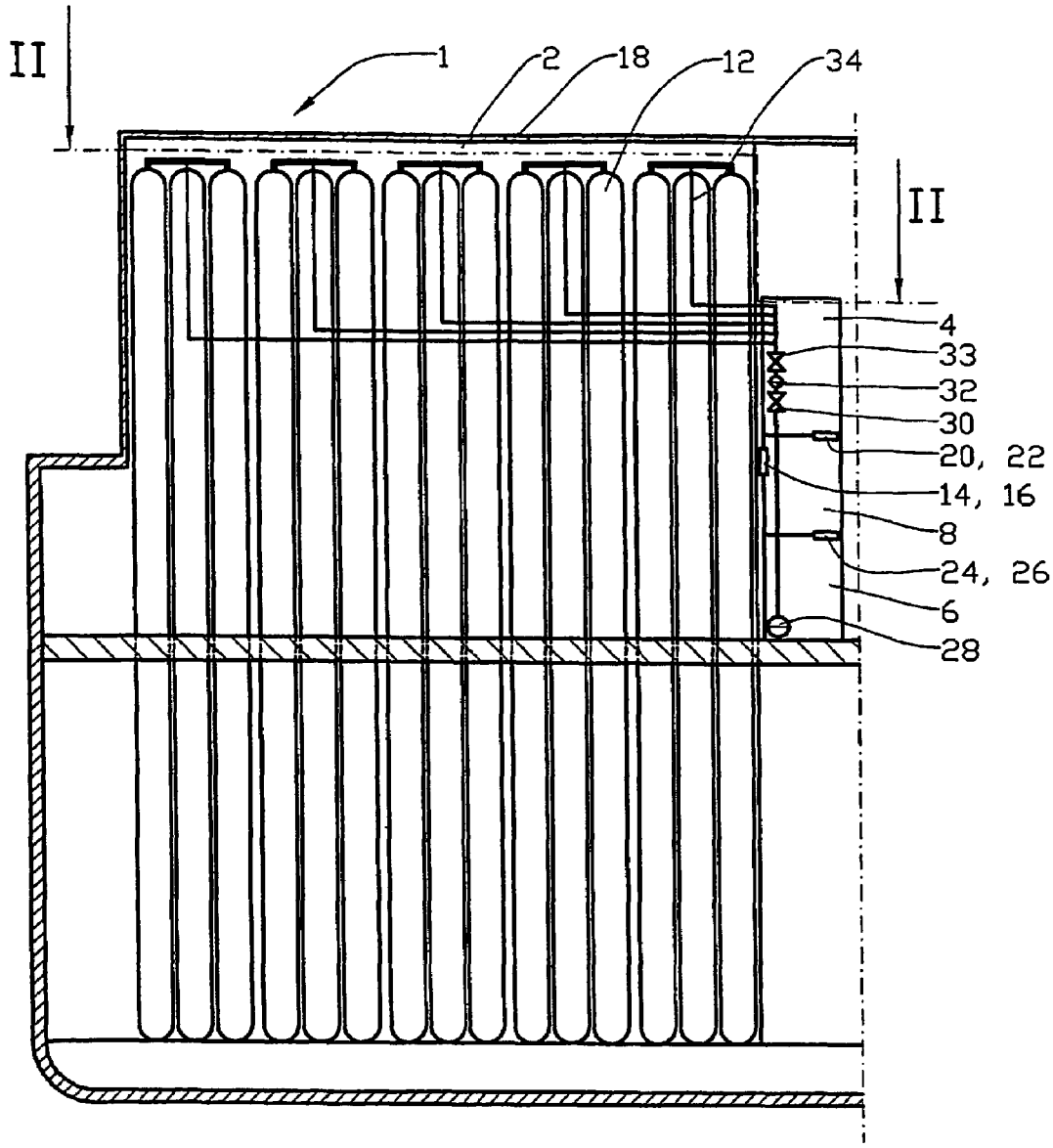
FIG. 2 shows a section I-I of FIG. 1.
Figure 3:
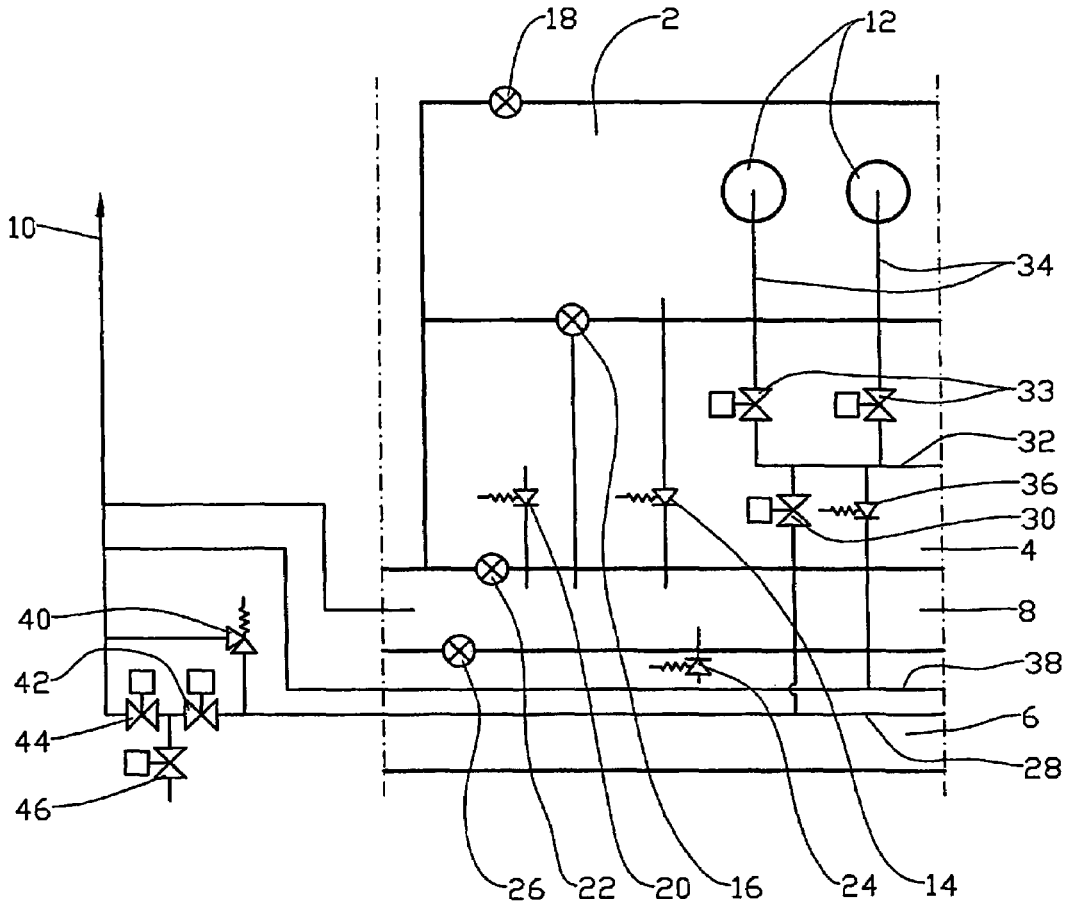
FIG. 3 shows a simplified circuit diagram of the hold section, valve compartment, pipe corridors, ventilating duct and piping.

In the drawings the reference numeral 1 indicates the hold of a ship, comprising mutually gastight hold sections 2. Each hold section 2 is provided with a valve compartment 4. Along the hold sections 2 extends an elongate pipe corridor 6 and a ventilating duct 8 arranged parallel to the pipe corridor 6, the ventilating duct 8 being connected to a discharge duct 10. The valve compartment 4, pipe corridor 6 and ventilating duct 8 are separated, mutually gastight, from each other and from the hold sections 2.

A number of cargo pressure tanks 12 are placed in each hold section 2.

Each hold section 2 is provided with a first pressure relief check valve 14 and a first rupture disc valve 16, both valves 14, 16 being arranged to open for gas to flow out of the hold section 2 and on into the ventilating duct 8 if the pressure within the hold section 2 exceeds predetermined pressure values. A second rupture disc valve 18 is arranged to open for gas to flow out of the hold section 2 into the atmosphere if the pressure within the hold section 2 exceeds a predetermined pressure.

The valve compartment 4 is provided with a second pressure relief check valve 20 and a third rupture disc valve 22, both valves 20, 22 being arranged to open for gas to flow out of the valve compartment 4 into the ventilating duct 8 if the pressure within the valve compartment 4 exceeds predetermined pressures.

The pipe corridor 6 is provided with a third pressure relief check valve 24 and a fourth rupture disc valve 26, both valves 24, 26 being arranged to open for gas to flow out of the pipe corridor 6 into the ventilating duct 8 if the pressure within the pipe corridor 6 exceeds predetermined pressures.

A loading and unloading pipe 28 extends inside the pipe corridor 6 and is connected through a first shut-off valve 30, a distribution pipe 32, a number of second shut-off valves 33 and connection pipes 34 to each cargo pressure tank 12 or groups of cargo pressure tanks 12.

The distribution pipe 32 is connected through a fourth pressure relief valve 36 to a drain pipe 38. The drain pipe 38 is connected to the discharge duct 10 and is disposed parallel to the loading and unloading pipe 28 in the pipe corridor 6. If the pressure within the distribution pipe 32 exceeds a predetermined value, the fourth pressure relief valve 36 opens, so that gas is drained in a controlled way through the drain pipe 38 and the discharge duct 10 into the atmosphere.

The loading and unloading pipe 28 communicates with the discharge duct 10 through a fifth pressure relief valve 40 and through a first controlled valve 42 connected in series with a second controlled valve 44. A suction valve 46 is connected between the two controlled valves 42 and 44.

A number of meters, not shown, together with a control system, not shown, are arranged to measure at least pressure and temperature in the cargo-holding portion of the ship and signal if an abnormal cargo condition should arise. The control system not shown is programmed to carry out relieving operations, such as the opening of controlled valves.

Should a leak occur in a cargo pressure tank 12 or one of the connecting pipes 34, causing the pressure within the hold section 2 to rise above a predetermined pressure, the first pressure relief valve 14 will open, so that gas can flow from the hold section 2 through the first pressure relief valve 14 into the ventilating duct 8 and then on into the atmosphere through the discharge duct 10.

If the pressure in the hold section 2 rises further, the first rupture disc valve 16 opens to a greater flow volume from the hold section 2 to the ventilating duct 8.

The second rupture disc valve 18 opens for gas to flow out of the hold section 2 into the atmosphere if the pressure within the hold section 2 should rise even more.

By a possible external leak in one of the shut-off valves 30, 33 or the portions of the connecting pipes 16 located in the valve compartment 4, the second pressure relief valve 20 opens for gas to flow through from the valve compartment 4 to the ventilating duct 8 whenever a predetermined pressure is present in the valve compartment 4. Should the pressure in the valve compartment 4 rise further, the third rupture disc valve 22 will open for gas to flow through from the valve compartment 4 to the ventilating duct 8.

By a possible leak in the loading and unloading pipe 28 and the drain pipe 38 located in the pipe corridor 6, the third pressure relief valve 24 will open for gas to flow through from the pipe corridor 6 into the ventilating duct 8 when a predetermined pressure is present in the pipe corridor 6. Should the pressure within the pipe corridor 6 rise further, the fourth rupture disc valve 26 will open for gas to flow through from the pipe corridor 6 into the ventilating duct 8.

The fifth pressure relief valve 40 is arranged to open for gas to flow through from the loading and unloading pipe 28 into the discharge duct 10 at a predetermined pressure within the loading and unloading pipe 28.

During repair work in the corridor 6, the loading and unloading pipe can be evacuated by opening the first controlled valve 42 and the suction valve 46.

The invention claimed is:

1. A device for protecting a loading space of a vessel from excess pressure caused by gas leakage, the loading space comprising a hold provided with cargo pressure tanks, wherein the vessel is provided with a ventilating duct that extends along the hold and is separated in a gastight manner from remaining rooms of the vessel, and further wherein the hold is divided into hold sections, each hold section being provided with a valve compartment separated in a gastight manner from the remaining rooms of the vessel, the valve compartment enclosing at least one shut-off valve which is arranged to shut off a pipe connection between a loading and unloading pipe and at least one of the cargo pressure tanks.

2. The device in accordance with claim 1, wherein the ventilating duct extends essentially parallel to a gastight pipe corridor, the pipe corridor enclosing the loading and unloading pipe.

3. The device of claim 2, wherein the hold communicates with the ventilating duct through at least one automatically opening valve.

4. The device of claim 1, wherein the valve compartment communicates with the ventilating duct through at least one automatically opening valve.

5. A device for protecting a loading space of a vessel from excess pressure caused by gas leakage, the loading space comprising a hold provided with cargo pressure tanks, wherein the vessel is provided with a ventilating duct that extends along the hold and is separated in a gastight manner from remaining rooms of the vessel, and further wherein;

the ventilating duct extends essentially parallel to a gastight pipe corridor, the pipe corridor enclosing a loading and unloading pipe; and the pipe corridor communicates with the ventilating duct through at least one automatically opening valve.

6. The device of claim 5, comprising a valve compartment that communicates with the ventilating duct through at least one automatically opening valve.

* * * * *